US007758033B2

(12) United States Patent
Terao et al.

(10) Patent No.: US 7,758,033 B2
(45) Date of Patent: Jul. 20, 2010

(54) SHEET POST-PROCESSING APPARATUS AND SHEET POST-PROCESSING METHOD

(75) Inventors: Yasunobu Terao, Izunokuni (JP); Mikio Yamamoto, Izunokuni (JP); Yoshiaki Sugizaki, Sunto-gun (JP); Hiroyuki Taki, Izunokuni (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 535 days.

(21) Appl. No.: 11/616,077

(22) Filed: Dec. 26, 2006

(65) Prior Publication Data

US 2007/0145660 A1 Jun. 28, 2007

(30) Foreign Application Priority Data

Dec. 26, 2005 (JP) ..... 2005-372754

(51) Int. Cl.
*B65H 37/04* (2006.01)

(52) U.S. Cl. ..... 270/58.02; 270/58.07; 270/58.08; 270/58.09; 270/58.11

(58) Field of Classification Search ..... 270/58.02, 270/58.07, 58.08, 58.09, 58.11
See application file for complete search history.

(56) References Cited

U.S. PATENT DOCUMENTS

2005/0062210 A1* 3/2005 Kato et al. ..... 270/58.08
2006/0066033 A1 3/2006 Terao et al.
2006/0066040 A1 3/2006 Terao et al.
2006/0066041 A1 3/2006 Terao et al.
2007/0063413 A1 3/2007 Terao et al.
2007/0065204 A1 3/2007 Terao et al.
2008/0150228 A1 6/2008 Terao

FOREIGN PATENT DOCUMENTS

JP 62-284565 5/1989
JP 08-026573 1/1996
JP 2004142868 A * 5/2004

* cited by examiner

*Primary Examiner*—Gene Crawford
*Assistant Examiner*—Leslie A Nicholson, III
(74) *Attorney, Agent, or Firm*—Turocy & Watson, LLP

(57) ABSTRACT

A sheet post-processing apparatus of the present invention has, above a processing tray, a standby tray for making a sheet stand by. The sheet on the standby tray is dropped and supplied onto the processing tray, so that a sheet feeding path between the standby tray and processing tray can be shortened. In the case where there exists no sheet on the sheet discharge tray when a sheet bundle is discharged onto the sheet discharge tray, one sheet is previously discharged onto the sheet discharge tray. Thus, by discharging the sheet bundle in a state where there is the one sheet on the sheet discharge tray, the sheet vertical alignment in the case where the sheet bundle is discharged onto the sheet discharge tray can be enhanced.

13 Claims, 14 Drawing Sheets

SHEET POST-PROCESSING APPARATUS AND SHEET POST-PROCESSING METHOD

CROSS REFERENCE TO RELATED APPLICATION

This application is based upon and claims the benefit of priority from prior Japanese Patent Application No. 2005-372754 filed on Dec. 26, 2005, the entire contents of which are incorporated herein by reference.

BACKGROUND OF THE INVENTION

1. Field of the Invention

The present invention relates to a sheet post-processing apparatus and a sheet post-processing method that perform post-processing for a sheet discharged from an image forming apparatus such as a copier, a printer, or a composite device.

2. Description of the Related Art

In recent years, there is developed a sheet post-processing apparatus, which is disposed adjacent to the sheet discharge section of an image forming apparatus main body for the purpose of performing post-processing, such as sorting and stapling, for a sheet on which an image has been formed in the image forming apparatus. The sheet post-processing apparatus performs post-processing for a succeeding sheet after completion of the post-processing for a preceding sheet. In order for the sheet post-processing apparatus to wait until the post-processing for a preceding sheet has been completed, an apparatus in which a retreating path is formed in the middle of a path reaching to a stapler is disclosed in Japanese Patent Publication (Kokoku) No. H6-99070.

However, in the case where the retreating path is formed in the middle of a path reaching to a stapler as described above, the length of a sheet path extending from the discharge section of the image forming apparatus main body to the stapler is increased. This may prevent size reduction of the entire apparatus.

Further, in such a sheet post-processing apparatus, when a plurality of sheets are aligned and bundled to be discharged onto a sheet discharge tray after completion of sheet post-processing, only the lowermost sheet contacting the surface of the sheet discharge tray may be displaced in some cases even though the sheet bundle are discharged in an aligned state. This displacement is caused due to a difference in the friction coefficient between the sheet and surface of the sheet discharge tray. The displacement may adversely affect the sheet alignment performance.

In light of the above, it is desirable to provide a sheet post-processing apparatus capable of reducing the distance between the sheet discharge section of an image forming apparatus and a processing mechanism that performs post-processing to thereby achieve miniaturization of the entire apparatus and enhancing the reliability of the sheet alignment when the sheet bundle is discharged onto the sheet discharge tray.

SUMMARY OF THE INVENTION

An aspect of the present invention is to reduce the distance of a sheet feeding path by dropping and supplying the sheet from the standby tray onto processing tray. Another aspect of the present invention is to prevent the discharged sheet bundle from being disturbed on the sheet discharge tray to thereby enhance the reliability of the sheet alignment.

According to an embodiment of the present invention, a sheet post-processing apparatus is characterized by containing a processing mechanism that performs post processing for a sheet discharged from an image forming apparatus, a sheet discharge tray which is arranged on the downstream side with respect to the processing mechanism and loads the sheet discharged from the image forming apparatus, a detection mechanism that detects whether the sheet has been placed or not on the sheet discharge tray, and a control mechanism that discharges a sheet bundle from the processing mechanism after discharging one sheet of the sheet bundle in the case where the detection mechanism detects no sheet on the sheet discharge tray before a plurality of sheets are discharged in a bundle from the processing mechanism onto the sheet discharge tray.

DETAILED DESCRIPTION OF THE PREFERRED EMBODIMENTS

Figure 1:
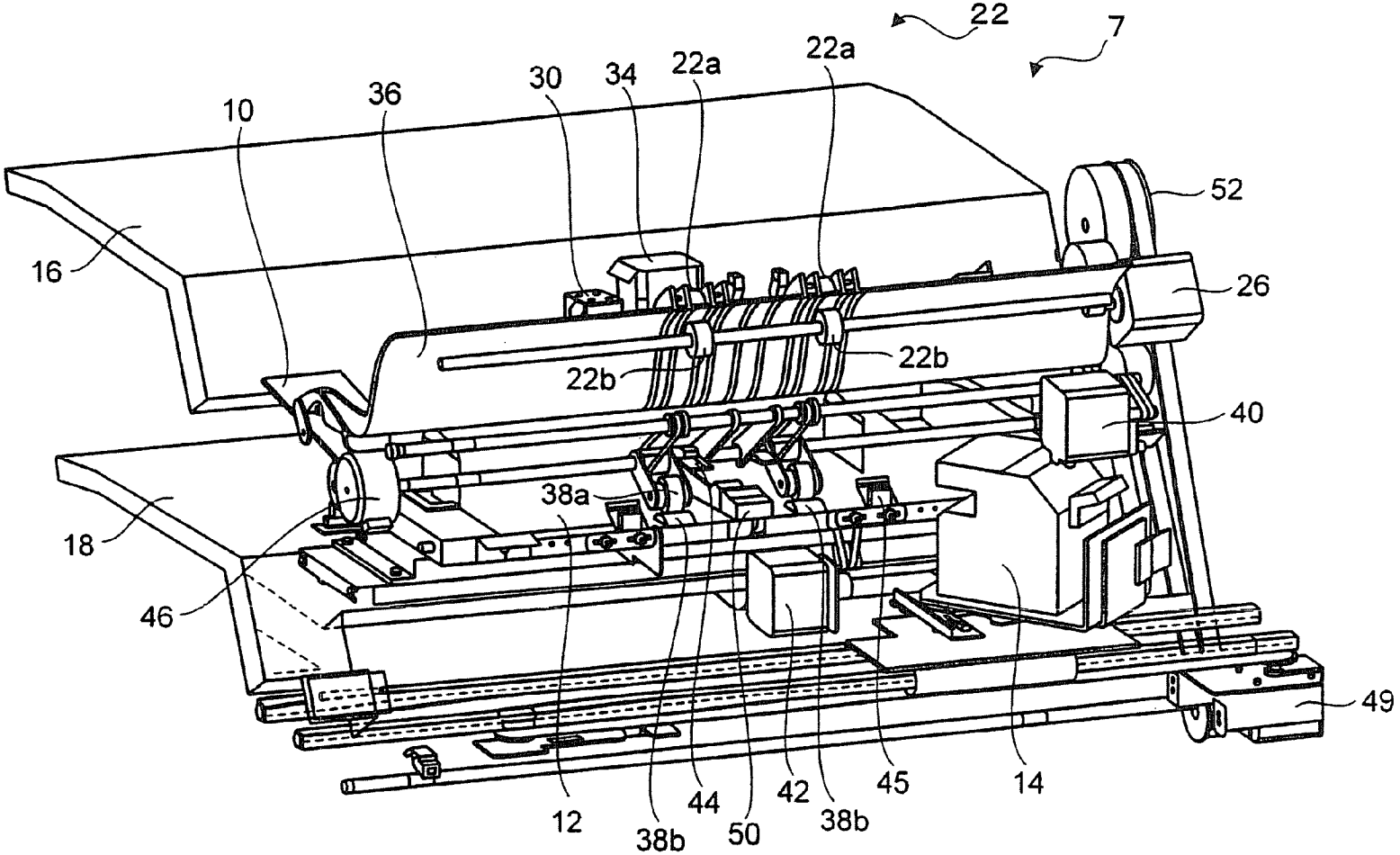
FIG. 1 is a perspective view showing the main part of a sheet post-processing apparatus according to an embodiment of the present invention.
Figure 2:
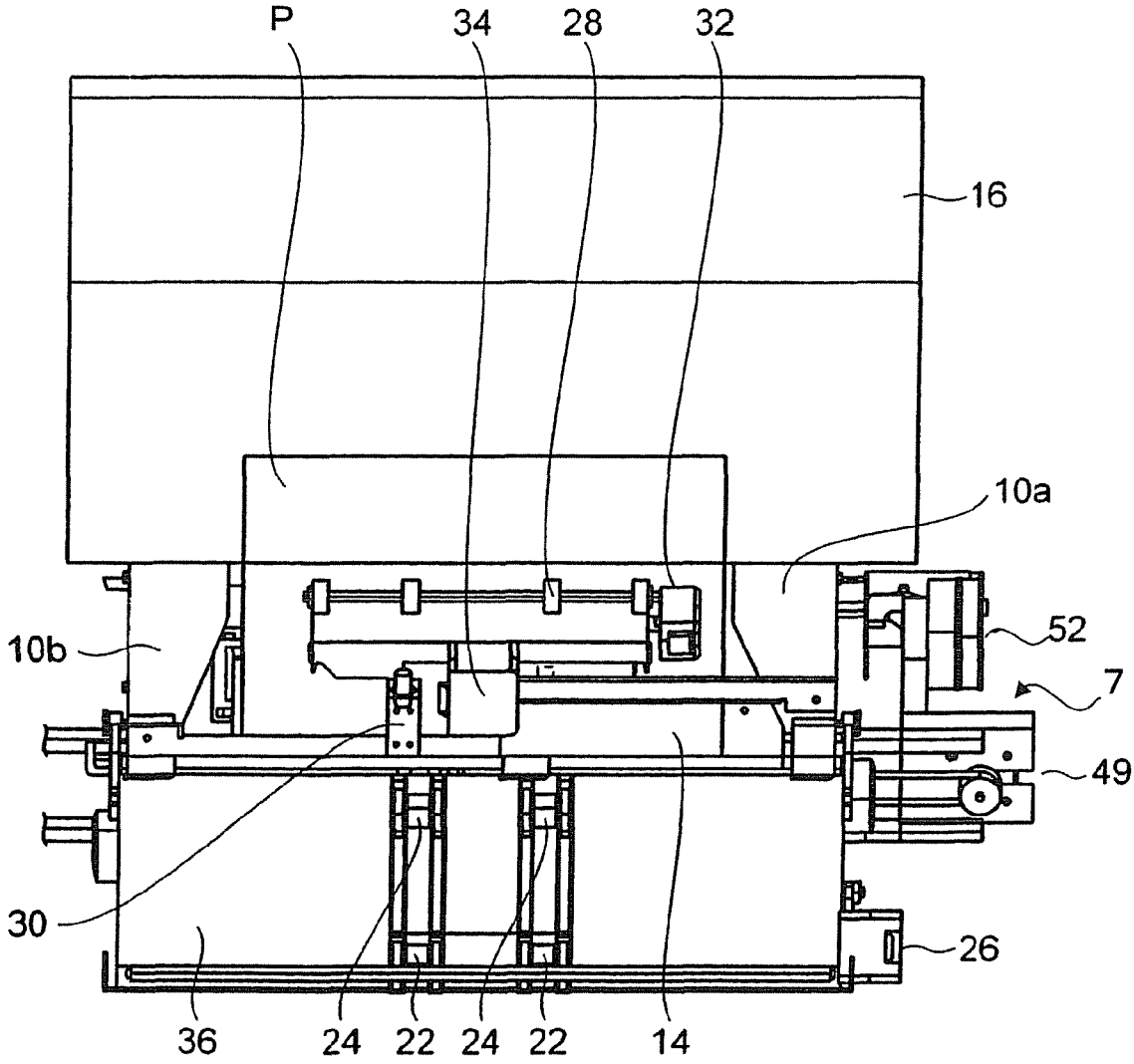
FIG. 2 is a top view of the main part of the sheet post-processing apparatus according to the embodiment of the present invention.
Figure 3A:
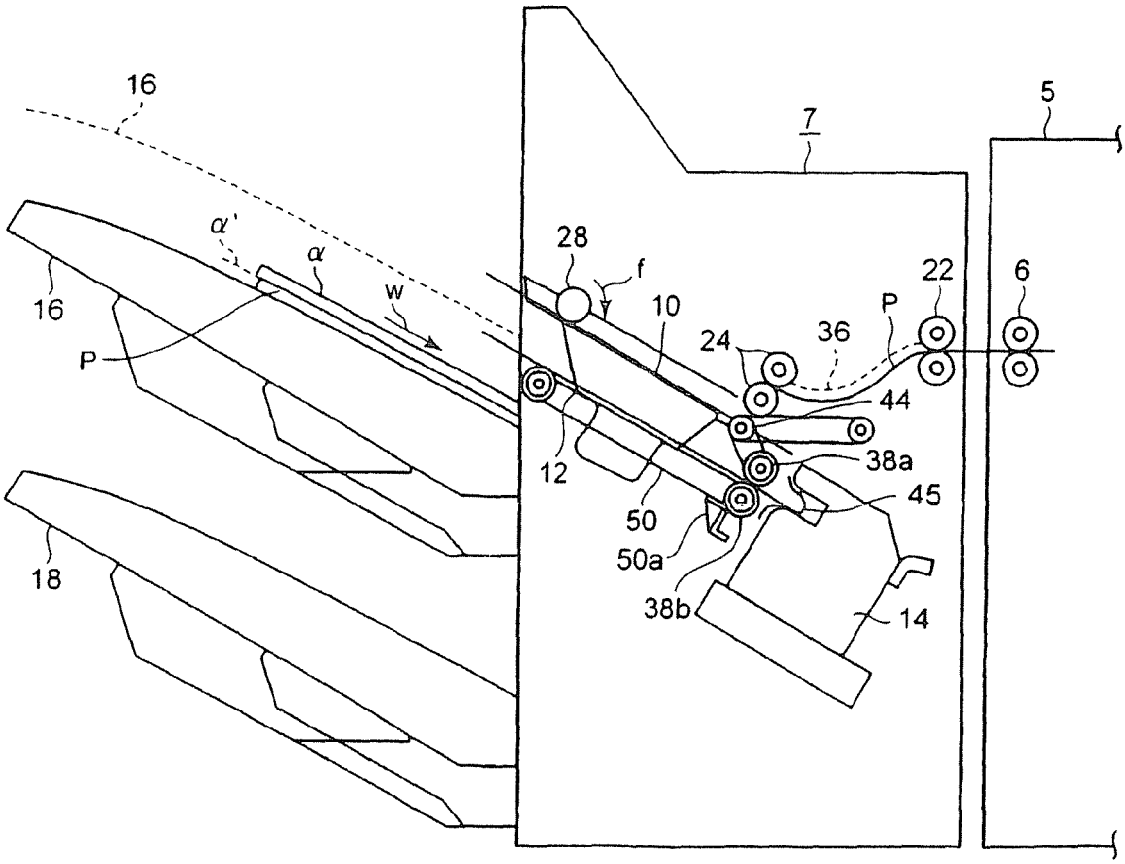
FIG. 3A is a view schematically explaining a configuration of the sheet post-processing apparatus according to the embodiment of the present invention in a state where sheets are discharged in a bundle onto a first sheet discharge tray (in the case where preceding sheets have been loaded onto the sheet discharge tray)
Figure 3B:
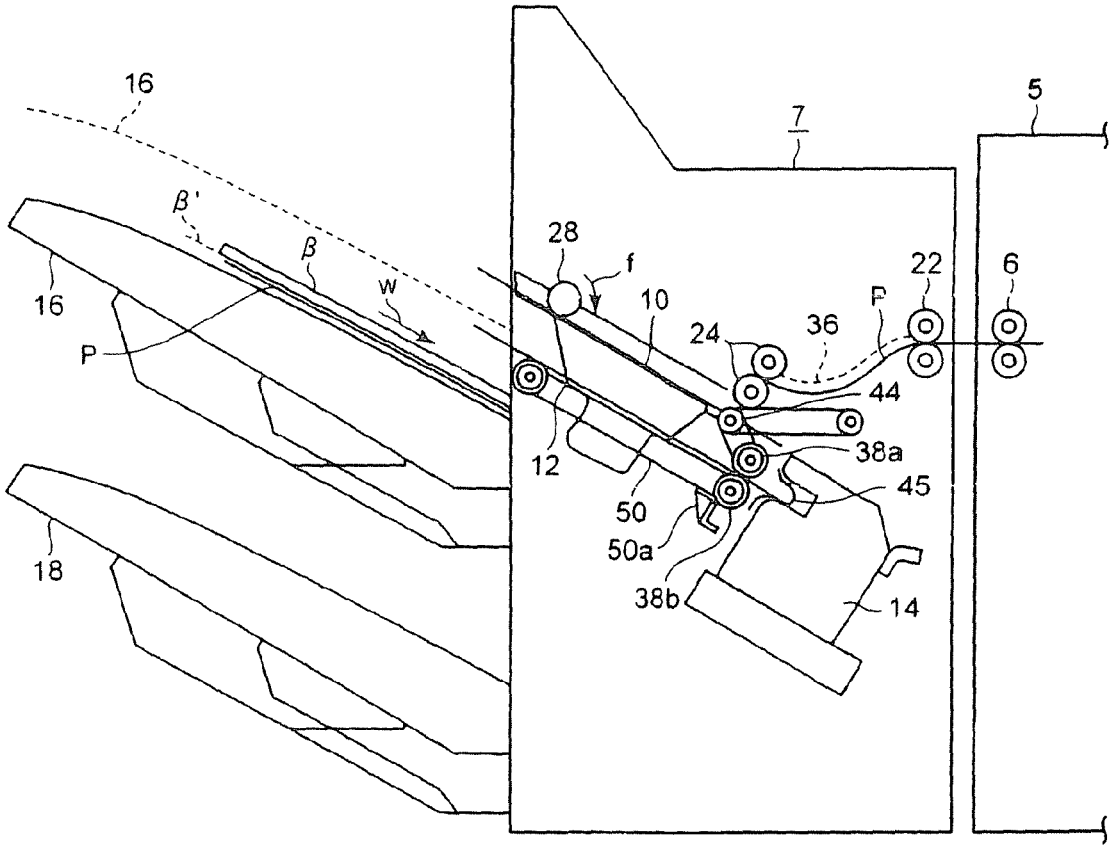
FIG. 3B is a view schematically explaining a configuration of the sheet post-processing apparatus according to the embodiment of the present invention in a state where sheets are discharged in a bundle onto a first sheet discharge tray (in the case where no preceding sheet exists on the sheet discharge tray)

Hereinafter, an embodiment of the present invention will be described in detail with reference to the accompanying drawings. FIG. 1 is a perspective view showing the main part of a sheet post-processing apparatus 7 according to an embodiment of the present invention. FIG. 2 is a top view of the main part of the sheet post-processing apparatus 7. FIGS. 3A and 3B are views each schematically showing a configuration of the sheet post-processing apparatus 7 disposed adjacent to an image forming apparatus 5 such as a copier.

The sheet post-processing apparatus 7 has a pair of entrance rollers 22 having an upper roller 22*a* and a lower roller 22*b* that feed a sheet P, on which an image has been formed by the image forming apparatus 5 and which is discharged by a pair of discharge rollers 6, into the sheet post-processing apparatus 7. The entrance rollers 22 are driven by an entrance roller motor 26. Between the entrance rollers 22 and a standby tray 10, a paper path ceiling 36 for leading the sheet P to a pair of sheet feed rollers 24 is installed. Under the standby tray 10, a processing tray 12 for loading the sheets P dropped and supplied from the standby tray 10 is arranged.

Figure 4:
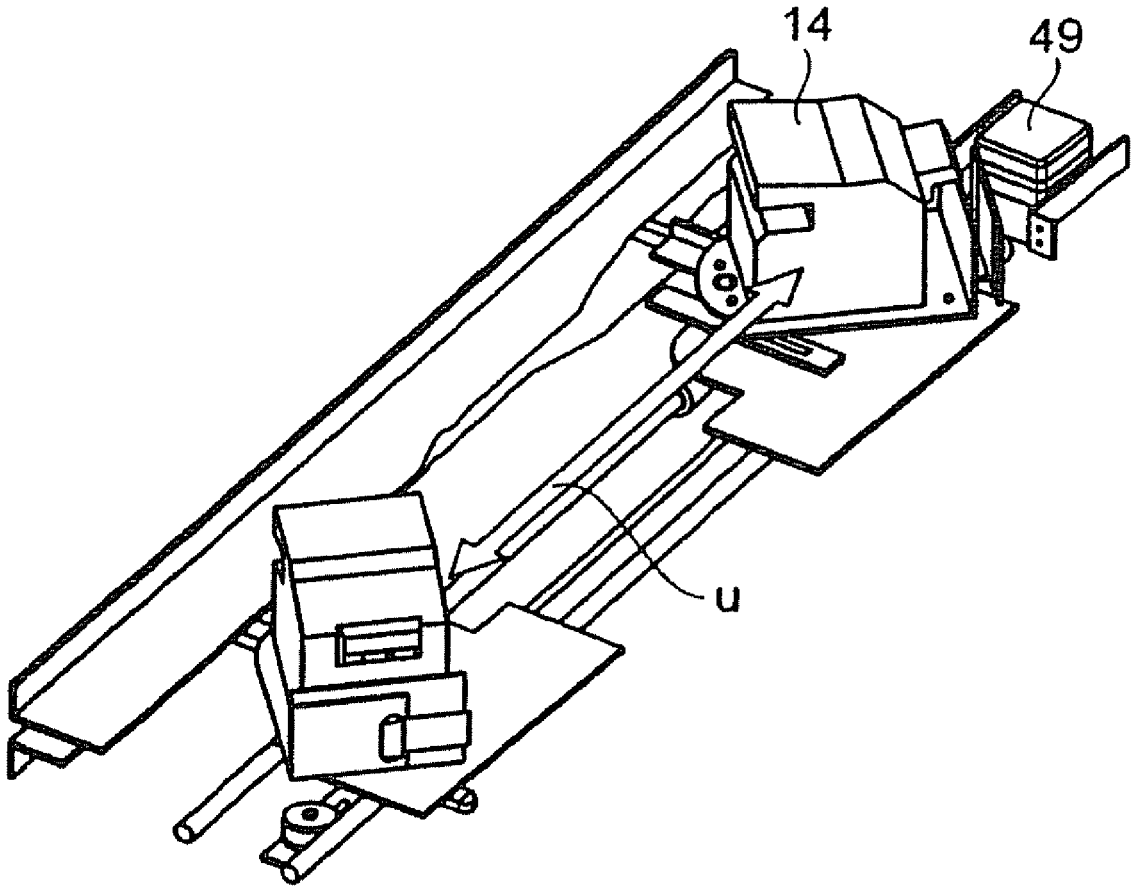
FIG. 4 is a perspective view showing a stapler of the sheet post-processing apparatus according to the embodiment of the present invention.
Figure 5:
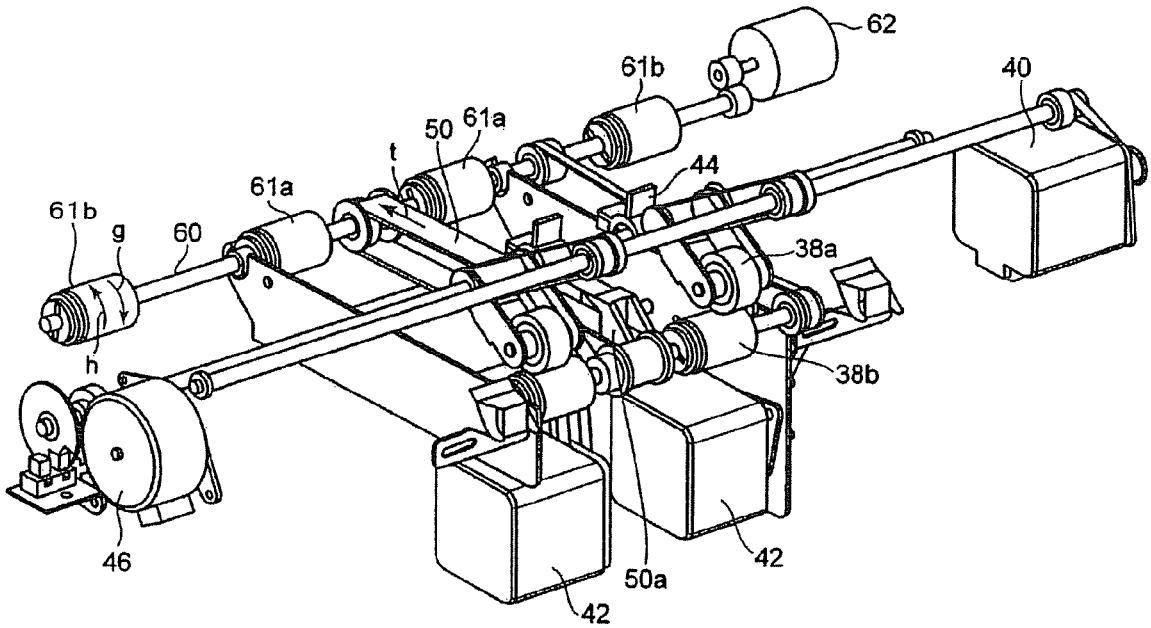
FIG. 5 is an explanatory view showing vertical alignment rollers according to the embodiment of the present invention.

While the sheets P are stapled by a stapler 14 which is a processing mechanism for performing post-processing, the processing tray 12, supports the sheets P to be loaded in an aligned state. As shown in FIG. 4, the stapler 14 is slidable by a staple drive section 49 in u direction denoted by the arrow in the illustration. The stapler 14 performs staple processing after being rotated in accordance with the staple direction and positioned. The processing tray 12 has a pair of upper vertical alignment roller 38*a* and lower vertical alignment roller 38*b* shown in FIG. 5 at the rear end side portion of the sheet P.

The upper vertical alignment roller 38*a* and lower vertical alignment roller 38*b* align a plurality of sheets dropped and supplied from the standby tray 10 in the vertical direction which is a feeding direction. The upper and lower vertical alignment rollers 38*a* and 38*b* serve as bundle feeding rollers for holding a sheet bundle T after stapled and taking out it from the stapler 14. The upper vertical alignment roller 38*a* is driven by a vertical alignment upper roller motor 40. The lower vertical alignment roller 38*b* is driven by a vertical alignment lower roller motor 42.

Figure 6:
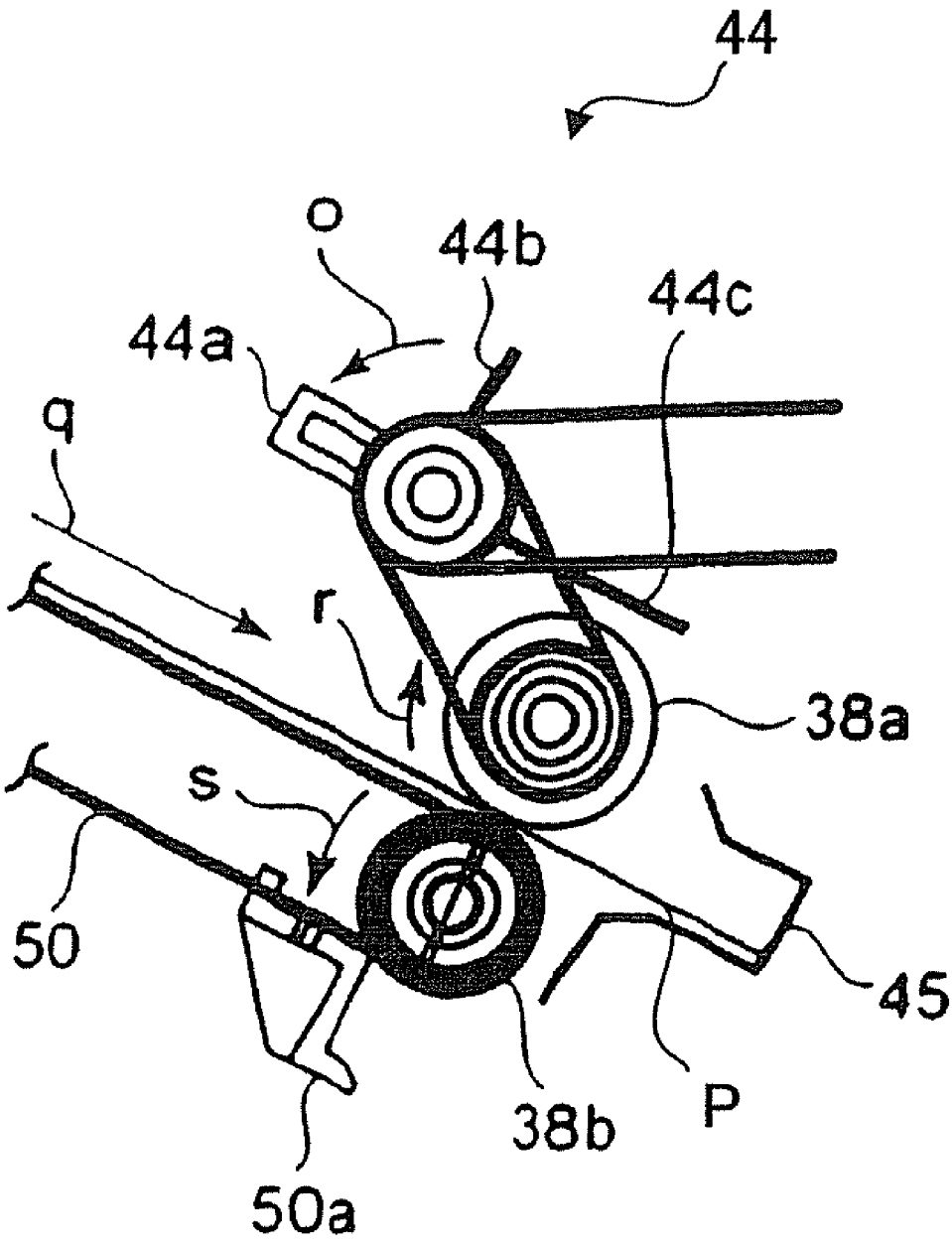
FIG. 6 is a perspective view showing a paddle mechanism according to the embodiment of the present invention.

At the position opposite to the rear end of each of the sheets P which have been dropped and supplied from the standby tray 10 onto the processing tray 12, a paddle 44 is arranged. The paddle 44, which is configured to be rotatable, aligns vertically the uppermost sheet P loaded on the processing tray 12. The paddle 44, as shown in FIG. 6, has a receiving portion 44*a* for the receiving the sheets P dropped and supplied from the standby tray 10 onto the processing tray 12, a beating portion 44*b* for beating down the sheets P on the processing tray 12, and a feeding portion 44*c* for aligning the sheets P on the processing tray 12. The puddle 44 is driven by a paddle motor 46. The paddle 44 is composed of an elastic rubber material and has elasticity.

At the end of the processing tray 12 on the side of the stapler 14, a stopper 45 for making contact with the rear end of each of the sheets P and vertically aligning the rear end position is arranged. Almost at the center of the processing tray 12, a conveyor belt 50 is installed. The conveyer belt 50 feeds the sheet bundle T, which is stapled and taken out from the stapler 14 by the upper and lower vertical alignment rollers 38*a* and 38*b*, to first or second sheet discharge tray 16 or 18. To the conveyer belt 50, a feed pawl 50*a* for hooking the rear end of the sheet bundle T is attached. The first or second sheet discharge tray 16 or 18 is configured to be slidable on the side surface of the sheet post-processing apparatus 7 in the vertical direction.

Figure 7:
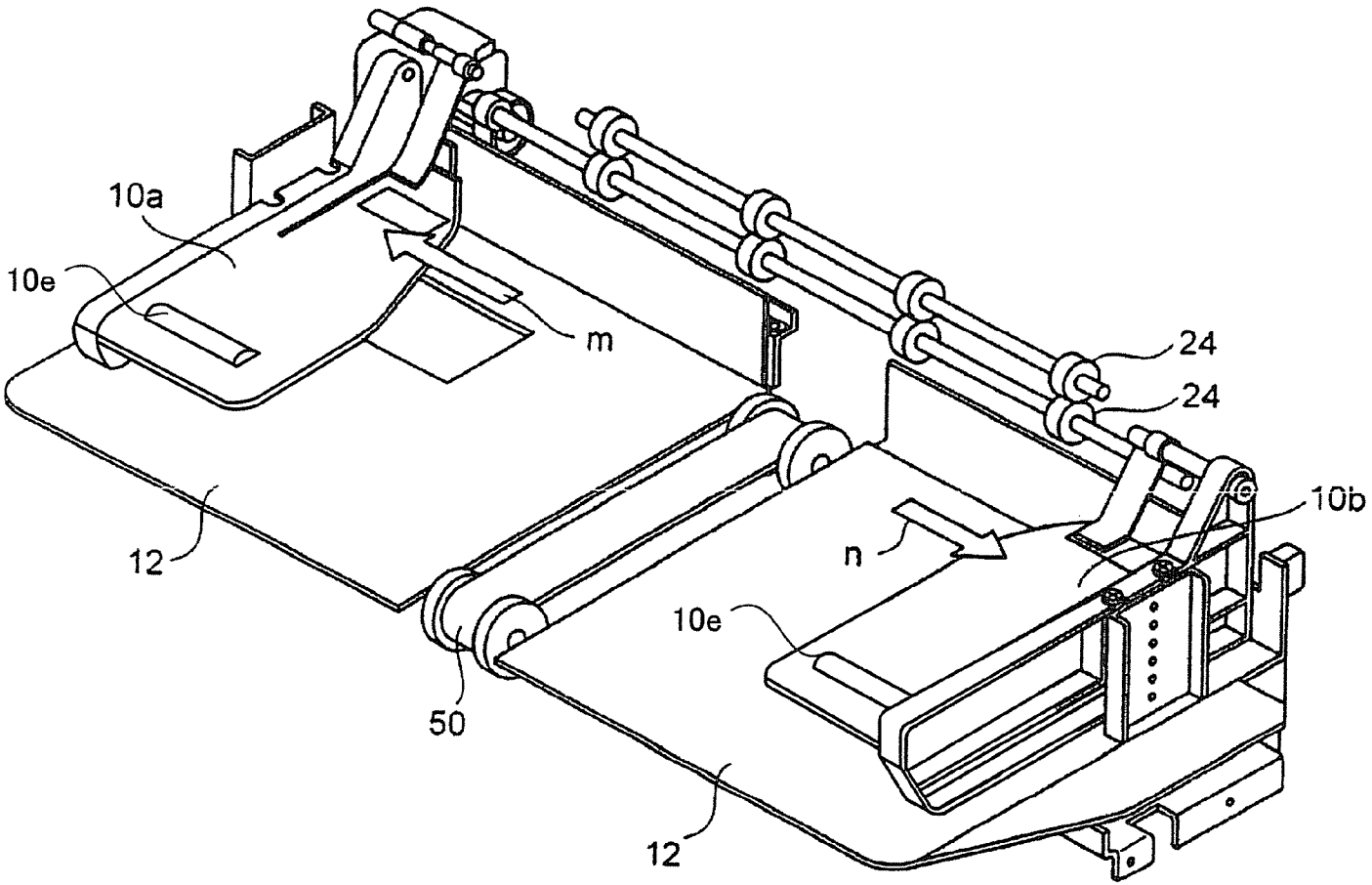
FIG. 7 is a perspective view schematically showing a standby tray and a processing tray according to the embodiment of the present invention.
Figure 8:
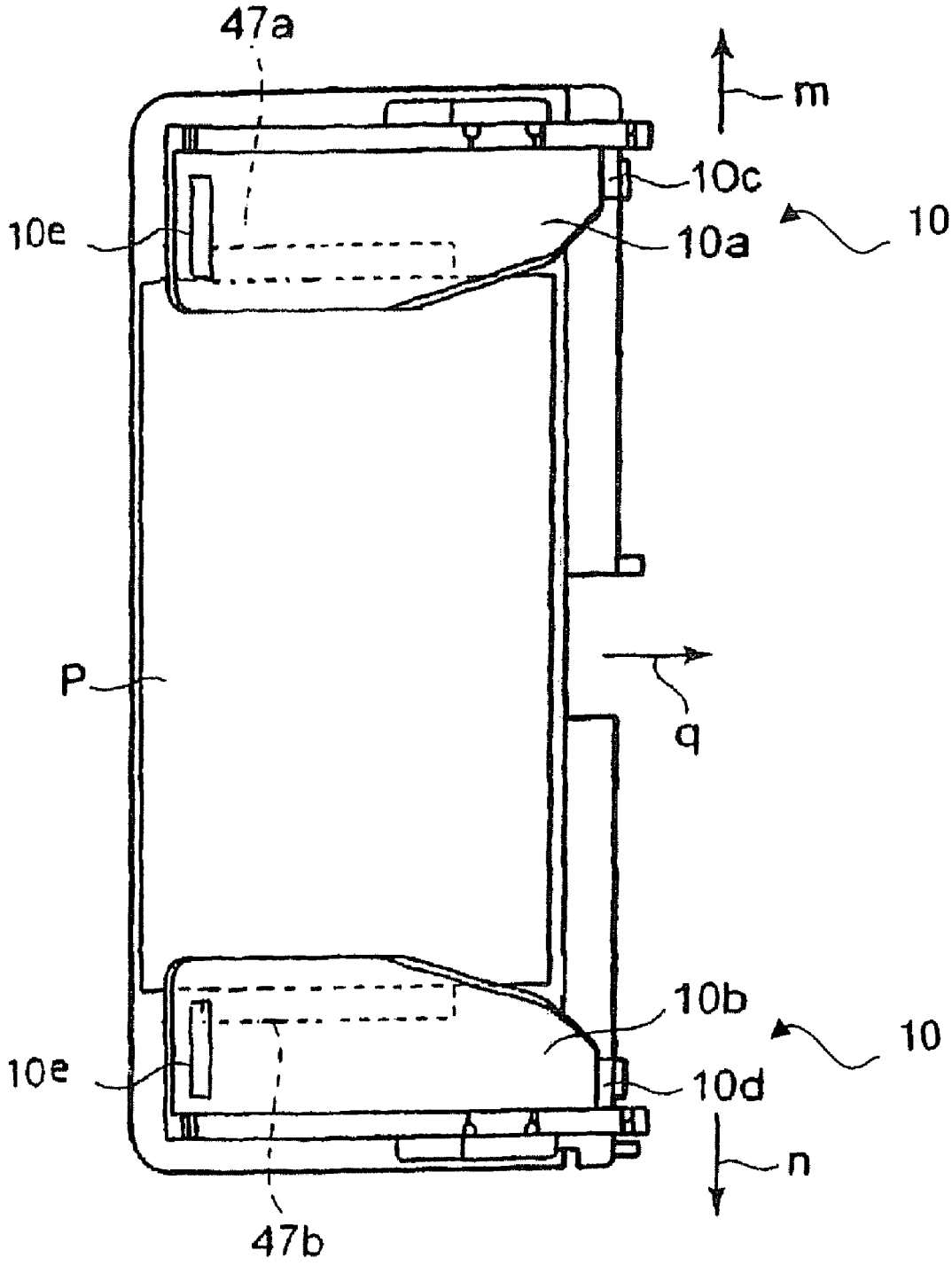
FIG. 8 is a top view of the standby tray and processing tray according to the embodiment of the present invention.

The standby tray 10 can drop and supply the sheets P onto the processing tray 12 and also can feed the sheets P toward the first or second sheet discharge tray 16 or 18. The standby tray 10 is so tilted as to support the sheets P such that the position of the front ends of the sheets P becomes higher than that of the rear ends thereof. As shown in FIGS. 7 and 8, the standby tray 10 has a pair of tray members 10*a* and 10*b*. The tray members 10*a* and 10*b* receive the sheets in a state that they slide in the width of the sheet P and support both sides of the sheet P. On the tray members 10*a* and 10*b*, standby stoppers 10*c* and 10*d* for aligning the rear ends of the sheets P are installed. The standby tray 10 slides and moves by a standby tray motor 34.

The standby tray 10 has pinch rollers 10*e* which hold the sheet P on the standby tray 10 between themselves and standby tray rollers 28 provided for aligning the sheet P and feed it toward the sheet discharge tray 16 or 18. Note that, without providing the pinch roller 10*e*, it is possible to feed the sheet P on the standby tray 10 toward the sheet discharge tray 16 or 18 only by the standby tray rollers 28. The standby rollers 28 are controlled by a standby tray roller drive source 30 in terms of their vertical movement and rotated by a standby tray roller motor 32.

Figure 9:
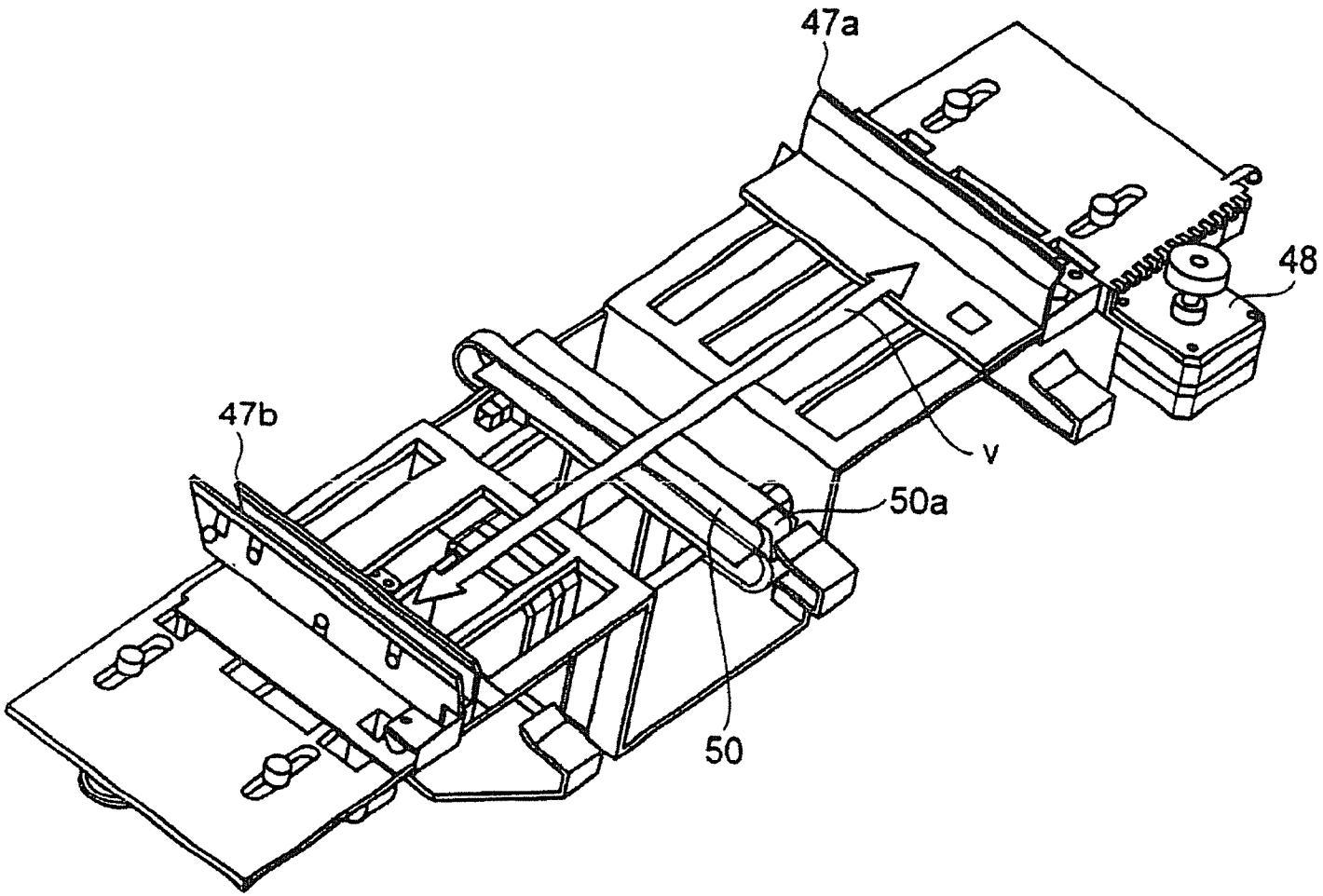
FIG. 9 is a perspective view schematically showing horizontal alignment plates and a conveyer belt according to the embodiment of the present invention.

Between the standby tray 10 and the processing tray 12, horizontal alignment plates 47*a* and 47*b* shown in FIG. 9 are installed. When the sheets P are dropped and supplied from the standby tray 10 onto the processing tray 12, the horizontal alignment plates 47*a* and 47*b* prevent the sheets P from turning away in the horizontal direction perpendicular to the feeding direction and horizontally align them. The horizontal alignment plates 47*a* and 47*b* are formed slidably in v direction denoted by the arrow in the illustration so as to fit to the width of the sheets P by a horizontal alignment motor 48.

One of the first and second sheet discharge trays 16 and 18 is selected, and the selected one is moved up and down by a sheet discharge drive section 52. The first or second sheet discharge tray 16 or 18 is moved up and down up to almost the same height as that of the sheet discharge section of the standby tray 10 or processing tray 12 when loading the sheets P to improve the consistency of the sheets P to be discharged. That is, the sheets P are not disturbed due to a difference in vertical positions. The first or second sheet discharge tray 16 or 18 is so tilted as to support the sheets P such that the position of the front ends of the sheets P becomes higher than that of the rear ends thereof.

Figure 10:
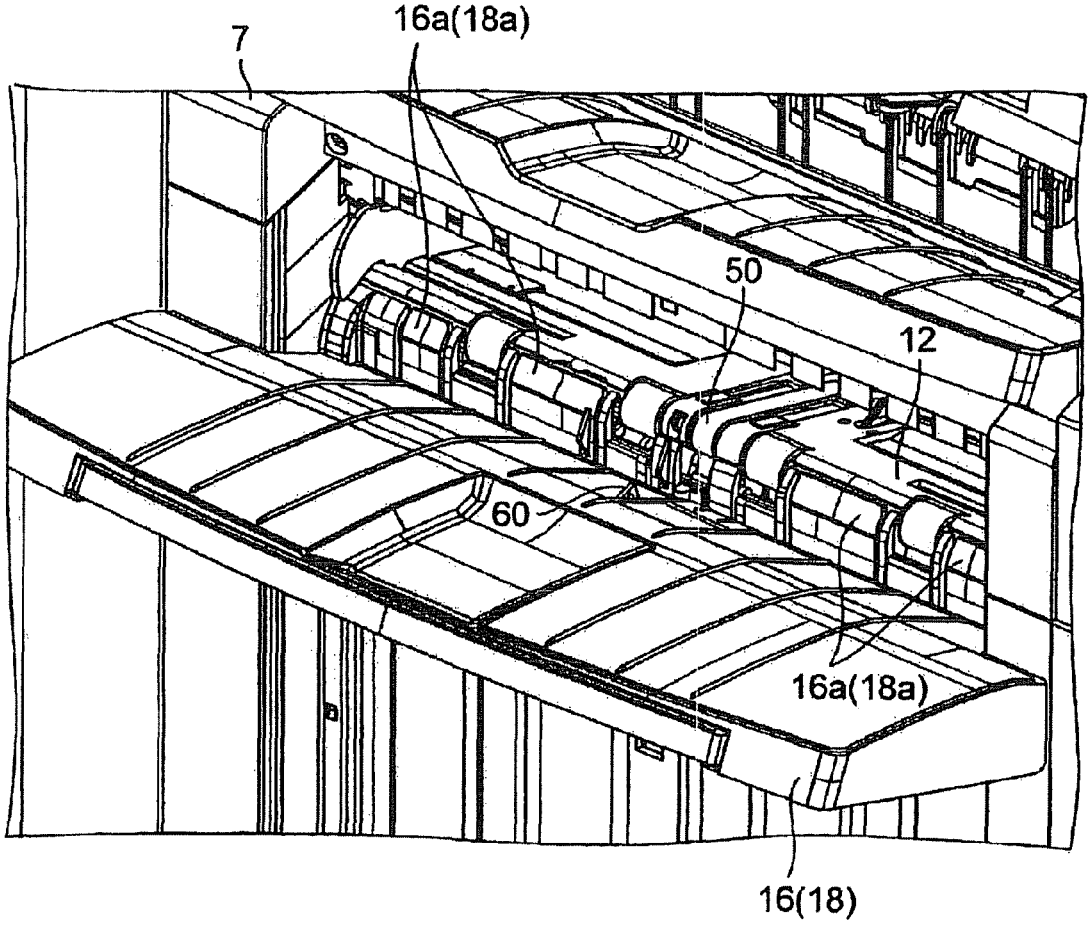
FIG. 10 is a perspective view schematically showing the sheet discharge tray according to the embodiment of the present invention.

As shown in FIG. 10, tray ribs 16*a* and 18*a* are formed on the attachment end side of the first or second sheet discharge tray 16 or 18. The tray ribs 16*a* and 18*a* are brought into contact with the rear end of the sheets P on the first or second sheet discharge tray 16 or 18 to thereby align the sheets P. On the first and second sheet discharge tray 16 and 18, a sheet detecting sensor 60 which is a detection mechanism for detecting whether there is any sheet P on the first or second sheet discharge tray 16 or 18 is provided. The sheet detecting sensor 60 is turned ON/OFF according to the weight of the sheet P and thereby mechanically detects the presence/absence of the sheet P.

Figure 11:
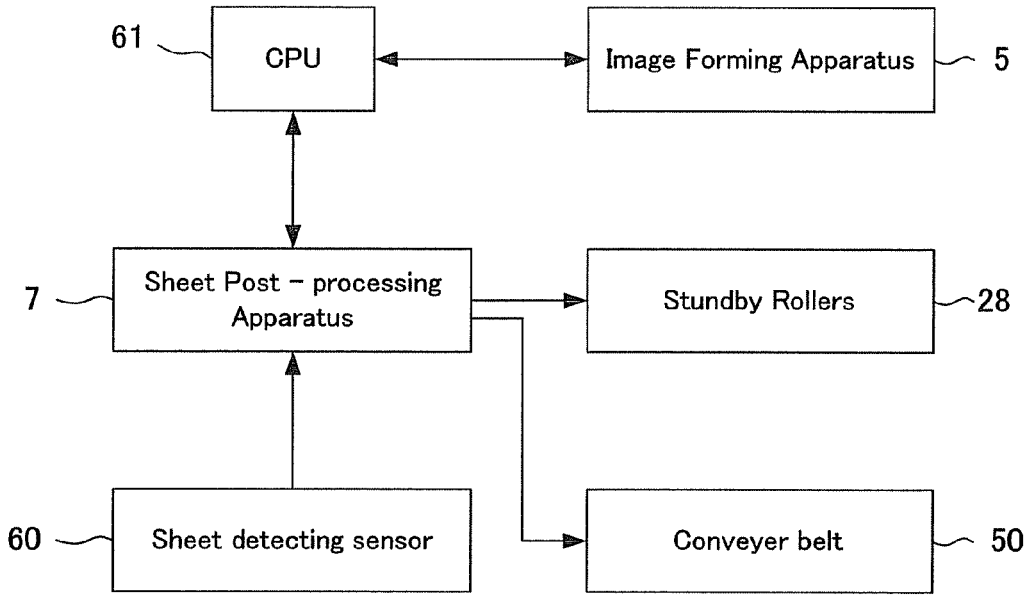
FIG. 11 is a block diagram showing a control system of the sheet post-processing apparatus according to the embodiment of the present invention.

FIG. 11 is a block diagram showing a control system of the image forming apparatus 5 and sheet post-processing apparatus 7. The image forming apparatus 5 and sheet post-processing apparatus 7 are connected to a CPU 61 which is a control mechanism. In the case where the sheets P are discharged in a bundle from the processing tray 12, the CPU 61 controls the drive of the standby rollers 28 or conveyer belt 50 in accordance with the detection result of the sheet detecting sensor 60.

Next, the operation of the present invention will be described. After an image has been formed on a sheet P in the image forming apparatus 5, the sheet P on which an image has been formed is discharged by the sheet discharge roller 6 of the image forming apparatus 5 to the sheet post-processing apparatus 7. When receiving the sheet P, the sheet post-processing apparatus 7 performs a different operation, depending on a case of performing the post-processing of the sheet P or a case of performing no post-processing. Or the sheet post-processing apparatus 7 performs a different operation, depending on a case of that the preceding sheet P is in execution of the post-processing or that is finished it.

When the post-processing is not to be performed, the first sheet discharge tray 16 is located at the position denoted by the dotted line in FIG. 3A and can load the sheets P discharged from the standby tray 10 in good consistency. When the post-process is not to be performed, the sheet P fed from the entrance rollers 22 to the sheet feed rollers 24 through the paper path ceiling 36 is fed to the standby tray 10 by the sheet feed rollers 24. Then, the sheet P is moved down onto the standby tray 10 and is fed while being held between the standby tray rollers 28 rotated in the direction of the arrow f and pinch rollers 10*e* of the standby tray 10 to be discharged onto the first sheet discharge tray 16 from the sheet discharge section of the standby tray 10.

In this way, on the first sheet discharge tray 16, sheets P directly discharged from the standby tray 10 are sequentially loaded. The first sheet discharge tray 16 is arranged in a tilted manner such that the front end of the sheet P is positioned higher than the rear end thereof, so that, the preceding sheet P loaded on the first sheet discharge tray 16 is not pressed out by making contact with the front end of the succeeding sheet P. Namely, the discharged sheet P is sequentially loaded on the first sheet discharge tray 16 unless the order is disturbed. Even if the preceding sheet P is pressed by the succeeding sheet P and is slightly displaced, the sheet P drops by its own weight to the rear end side. As a result, the sheets P are loaded on the first sheet discharge tray 16 with the rear ends thereof aligned, and the discharge processing of the sheets P is thus completed.

Next, a case where staple processing which is a post-processing is to be performed and no preceding sheets P in execution of the staple processing remain on the processing tray 12 will be described. At this time, the standby tray 10 slides and moves the tray members 10*a* and 10*b* respectively up to the positions indicated by the dotted lines in FIG. 12 in the directions of arrows m and n to open the dropping and supplying path of the sheet P. The horizontal alignment plates 47*a* and 47*b*, to align the sheet P dropping from the sheet feed rollers 24 in the horizontal direction, are arranged so that the gap between the horizontal alignment plates 47*a* and 47*b* is made almost equal to the width of the sheet P. By doing this, the sheet P fed by the sheet feed rollers 24, without the feeding being obstructed by the standby tray 10, is dropped and supplied directly onto the processing tray 12.

At the time of dropping and supplying, the upper vertical alignment roller 38*a* is shifted upward. Both sides of the sheet P drop in contact with the horizontal alignment plates 47*a* and 47*b* and are aligned in the horizontal direction. The rear end of the sheet P dropped and supplied onto the processing tray 12 is placed on the receiving portion 44*a* of the paddle 44. Then, the paddle 44 rotates in the direction of the arrow o, drops the rear end of the sheet P from the receiving portion 44*a*, and beats down it onto the processing tray 12 by the beating portion 44*b*. Furthermore, the paddle 44 feeds the sheet P in the direction of the arrow q by the feeding portion 44*c* and brings the rear end of the sheet P into contact with stopper 45 and thereby the vertical alignment of the sheet P is accomplished. The vertical alignment of the sheet P on the processing tray 12 may be performed by moving up and down the upper vertical alignment roller 38*a* for each alignment operation and by rotating it in the opposite direction to the arrow r.

In this way, the sheet P on which an image has been formed is loaded directly on the processing tray 12 from the sheet feed rollers 24 while sequentially being aligned in the horizontal direction and vertical direction. When the sheets P reach a predetermined number, the stapler 14 staples the sheets P on the processing tray 12 at a desired position and bundles them to form the sheet bundle T. Thereafter, the upper vertical alignment roller 38*a* is moved down onto the sheet bundle T. The sheet bundle T is then held between the upper vertical alignment roller 38*a* rotated in the direction of the arrow r and the lower vertical alignment roller 38*b* rotated in the direction of the arrow s and is fed toward the first sheet discharge tray 16. When the rear end of the sheet bundle T passes the upper and lower vertical alignment rollers 38*a* and 38*b*, it is hooked by the feed pawl 50*a* of the conveyor belt 50 rotated in the direction of the arrow t and is sent to the first sheet discharge tray 16.

At this time, the first sheet discharge tray 16 has been slid from the position denoted by the dotted line in FIG. 3A to the position denoted by the solid line. The first sheet discharge tray 16 is arranged in a tilted manner and therefore the front end of the sheet P is positioned higher than the rear end thereof, so that the preceding sheet P sent to the first sheet discharge tray 16 is not pressed out by making contact with the front end of the succeeding sheet bundle T. Further, even if the preceding sheet bundle T is slightly displaced by the succeeding sheet P, since the first sheet discharge tray 16 is arranged in a tilted manner, the sheet bundle T drops by its own weight and is loaded on the first sheet discharge tray 16 with the rear end thereof aligned, and thus the stapling processing of the sheet bundle T is completed.

Next, a case where the staple processing which is a post-processing is to be performed and preceding sheets P in execution of the staple processing remain on the processing tray 12 will be described. At this time, the standby tray 10 slides and moves the tray members 10*a* and 10*b* from the position indicated by the dashed line in FIG. 12 respectively in the opposite direction of the direction of the arrow m and in the opposite direction of the direction of the arrow n, and is moved to the position indicated by the solid line shown in FIG. 12, and can support the sheet P. The standby tray rollers 28 are shifted above the standby tray 10 so as not to disturb the sheets P. The sheets P discharged from the image forming apparatus 5 and fed by the sheet feed rollers 24 are loaded once on the standby tray 10 to wait for the processing tray 12 to be free.

After the sheets P are loaded on the standby tray 10, the standby tray rollers 28 are moved down onto the standby tray 10 and are rotated in the opposite direction of the direction of the arrow f. As a result, the sheets P are sent toward the standby stoppers 10*c* and 10*d* and are vertically aligned with the rear end of the sheets P brought into contact with the standby stoppers 10*c* and 10*d*.

The standby tray 10 is arranged in a tilted manner. Thus, even if, for example, the succeeding sheet P is fed from the sheet feed rollers 24 in a state that it is curled convexly and is fed to the standby tray 10, the preceding sheet P loaded on the standby tray 10 is not pressed out by making contact with the front end of the succeeding sheet P. Namely, the fed sheet P is sequentially loaded on the standby tray 10 unless the order is disturbed. Further, even if the preceding sheet P is pressed by the succeeding sheet P and is slightly displaced, since the standby tray 10 is arranged in a tilted manner, the sheet P drops by its own weight down to the position where the rear end thereof is brought into contact with the standby stoppers 10*c* and 10*d* and is loaded on the standby tray 10 with the rear end aligned.

Figure 12:
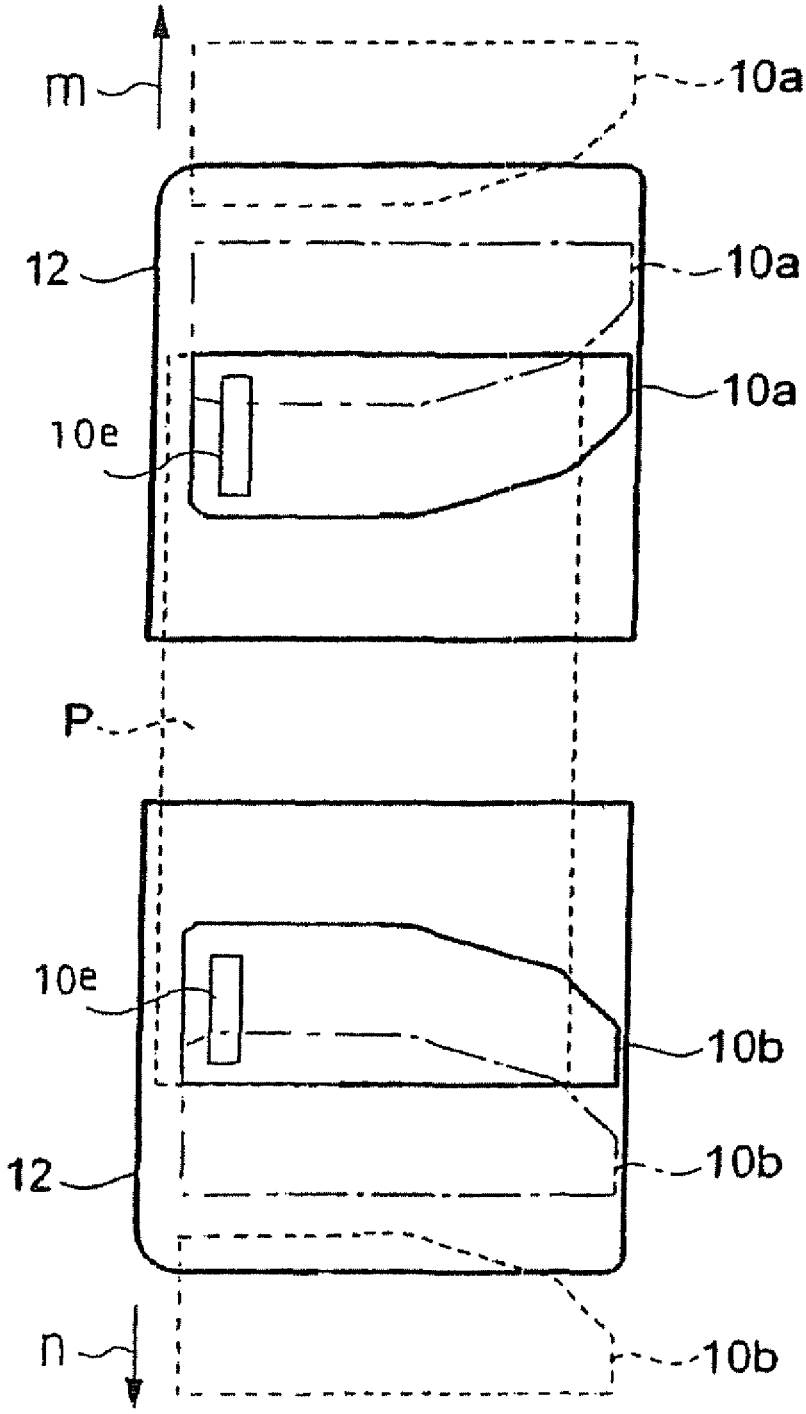
FIG. 12 is an explanatory view showing the movement of the standby tray according to the embodiment of the present invention.

During this period, when the preceding sheet P on the processing tray 12 is discharged on the side of the first sheet discharge tray 16 and the processing tray 12 becomes free, the standby tray 10 slides and moves the tray members 10*a* and 10*b* respectively up to the positions indicated by the dotted lines in FIG. 12 in the directions of the arrows m and n from the position indicated by the solid line in FIG. 12 via the position indicated by the alternate long and short dash line in FIG. 12. By doing this, for example, two sheets P standing by on the standby tray 10, when the tray members 10*a* and 10*b* reach the position indicated by the alternate long and short dash line in FIG. 12, are dropped and supplied onto the processing tray 12 from between the tray members 10*a* and 10*b*. At this time, the horizontal alignment plates 47*a* and 47*b* are arranged so as to make the interval between them almost equal to the width of the sheets P. Therefore, the sheets P dropped from the standby tray 10 are controlled on both sides by the horizontal alignment plates 47*a* and 47*b* and are aligned horizontally.

The lower side sheet P of the two sheets P dropped onto the processing tray 12 is sent in the direction of the arrow q by the lower vertical alignment roller 38*b* rotated in the opposite direction of the direction of the arrow s, and the rear end of the sheet P is brought into contact with the stopper 45, and the vertical alignment of the sheet P is accomplished. The upper side sheet P of the two sheets P dropped onto the processing tray 12 is sent in the direction of the arrow q by the upper vertical alignment roller 38*a* rotated in the opposite direction of the direction of the arrow r, and the rear end of the sheet P is brought into contact with the stopper 45, and the vertical alignment of the sheet P is accomplished. Thereafter, the upper vertical alignment roller 38*a* is shifted upward.

The third and subsequent sheets P discharged from the image forming apparatus 5 are directly dropped and supplied onto the processing tray 12 from between the tray members 10*a* and 10*b* without standing by on the standby tray 10. Thereafter, the third and subsequent sheets P are sequentially aligned on the sheets P loaded earlier on the processing tray 12 by the paddle 44.

When the sheets P loaded on the processing tray 12 reach a predetermined number, the sheets P are stapled by the stapler 14 to form a sheet bundle T. Thereafter, the sheet bundle T is fed toward the first sheet discharge tray 16 by the upper and lower vertical alignment rollers 38*a* and 38*b*. The rear end of the sheet bundle T is hooked by the feed pawl 50*a* of the conveyor belt 50 and the sheet bundle is sent to the first sheet discharge tray 16. Thus, the stapling processing of the sheets P is completed.

Figure 13:
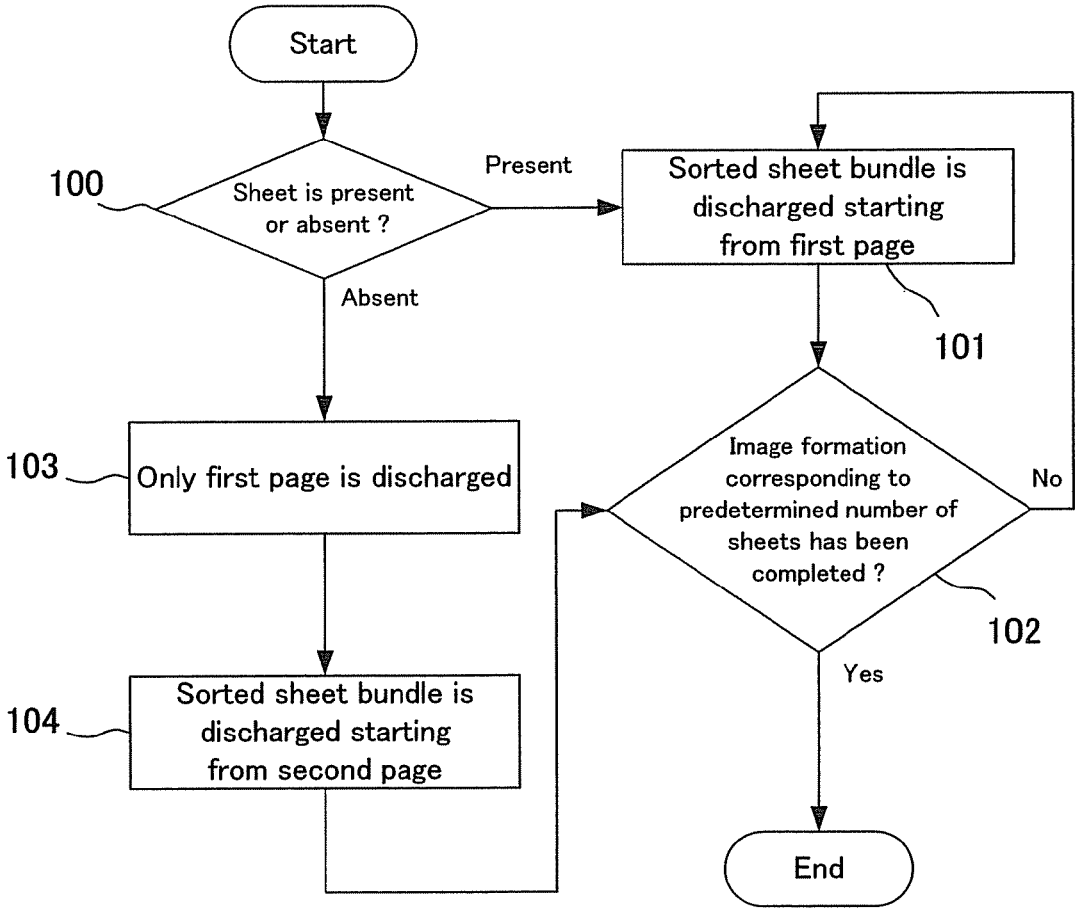
FIG. 13 is a flowchart showing a state where sheets are discharged in a bundle in the embodiment of the present invention.

Next, a case where the staple processing is not to be performed but a predetermined number of sheets P loaded on the processing tray 12 are discharged in a bundle at the time of sorting will be described. As shown in the flowchart of FIG. 13, after sheet bundle discharge operation is started, the sheet detecting sensor 60 on the first sheet discharge tray 16 is used to detect the presence/absence of the sheet P on the first sheet discharge tray 16 (step 100). Here, it is assumed that the sheet P exists on the first sheet discharge tray 16 as shown in FIG. 3A and the sheet detecting sensor 60 detects the sheet P. After the detection, the flow advances to step 101.

In step 101, the sheets P supplied by the sheet feed rollers 24 through the entrance rollers 22 are sequentially dropped and supplied onto the processing tray 12 and loaded thereon in the sorting order. In the case where preceding sheets P in execution of the post-processing remain on the processing tray 12, the sheets P are loaded once on the standby tray 10 to wait for the processing tray 12 to be free. If the processing tray 12 becomes free, the sheets P are directly dropped and supplied onto the processing tray 12 in a sequential manner.

While being dropped from the sheet feed rollers 24, the sheets P are horizontally aligned by the horizontal alignment plates 47*a* and 47*b*. After that, the sheets P supplied onto the processing tray 12 are vertically aligned by the upper and lower vertical alignment rollers 38*a* and 38*b* and paddle 44. After a predetermined sorting has been made from the first page on the processing tray 12, a first discharge process of discharging a sorted sheet bundle a onto the first sheet discharge tray 16 starting from the first page is executed. In this sheet bundle discharge process, the conveyer belt 50 is rotated in the direction of the arrow t to hook the sorted sheet bundle $\alpha$ using the feed pawl 50*a*. In this state, the sorted sheet bundle $\alpha$ is sent to the first sheet discharge tray 16.

Utilizing the tilt of the first sheet discharge tray 16, the sorted sheet bundle $\alpha$ that has been discharged is moved back in the direction of the arrow w which is a direction toward the sheet rear end. Then, the sorted sheet bundle $\alpha$ is brought into contact with the first tray rib 16*a* at its rear end and thereby is vertically aligned. At this time, the preceding sheet P exists on the first sheet discharge tray 16. Therefore, friction forces occurring on both front and back surfaces of a lowermost sheet $\alpha'$ of the discharged sorted sheet bundle $\alpha$ substantially correspond to each other. As a result, the lowermost sheet $\alpha'$ of the discharged sorted sheet bundle $\alpha$ does not remain as denoted by the dotted line in FIG. 3A but is moved back in the direction of the arrow w together with the upper sheets and thereby vertical alignment of the sorted sheet bundle $\alpha$ is accomplished. After that, step 101 is repeated until image formation operation corresponding to a predetermined number of sheets has been ended. When it is determined that the image formation operation corresponding to a predetermined number of sheets has been completed in step 102, the post-processing operation is ended.

On the other hand, when the sheet detecting sensor 60 has detected the absence of the sheet on the first sheet discharge tray 16 in step 100, the flow advances to step 103. In step 103, only the first page of the sheets P is discharged onto the first sheet discharge tray 16 before the sheets P is discharged in a bundle. More specifically, the first page of the sheets P fed by the sheet feed rollers 24 through the entrance rollers 22 is directly discharged onto the first sheet discharge tray 16 from the standby tray 10 by the standby tray rollers 28 under the control of the CPU 61.

Utilizing the tilt of the first sheet discharge tray 16, the first page that has been discharged is moved back in the direction of the arrow w which is a direction toward the sheet rear end up to the position where it is brought into contact with the first tray rib 16*a*. Then the flow advances to step 104, where the second and subsequent pages fed by the sheet feed rollers 24 from the entrance rollers 22 are sequentially dropped and supplied onto the processing tray 12. While being dropped from the sheet feed rollers 24, the sheets P are horizontally aligned by the horizontal alignment plates 47*a* and 47*b*. After that, the sheets P supplied onto the processing tray 12 are vertically aligned by the upper and lower vertical alignment rollers 38*a* and 38*b* and paddle 44.

After a predetermined sorting has been made from the second page on the processing tray 12, a second discharge process of discharging a sorted sheet bundle β onto the first sheet discharge tray 16 starting from the second page is executed. In this sheet bundle discharge process, the conveyer belt 50 is rotated in the direction of the arrow t to hook the sorted sheet bundle β using the feed pawl 50*a*. In this state, the sorted sheet bundle β is sent to the first sheet discharge tray 16.

At this time, the first page of the sheets P has already been discharged onto the first sheet discharge tray 16, so that when the sorted sheet bundle β that has been obtained by stacking the second and subsequent pages is discharged onto the first page, sorting of the sheets P having all pages has been made on the first sheet discharge tray 16. Utilizing the tilt of the first sheet discharge tray 16, the sorted sheet bundle β starting from the second page is moved back in the direction of the arrows w, brought into contact with the first tray rib 16*a* at its rear end and thereby is vertically aligned together with the first page.

At this time, the preceding sheet P (first page) exists on the first sheet discharge tray 16.

Therefore, friction forces occurring on both front and back surfaces of a lowermost sheet β' of the discharged sorted sheet bundle β starting from the second page substantially correspond to each other. As a result, the lowermost sheet β' of the discharged sorted sheet bundle β does not remain as denoted by the dotted line in FIG. 3B but is moved back in the direction of the arrow w together with the upper sheets and thereby vertical alignment of the sorted sheet bundle β is accomplished. After that, the flow advances to step 102, where step 101 is repeated until image formation operation corresponding to a predetermined number of sheets has been ended. When it is determined that the image formation operation corresponding to a predetermined number of sheets has been completed in step 102, the post-processing operation is ended.

In the case where the sheet bundle is discharged after the stapling processing, the lowermost sheet is vertically aligned, due to a binding force of the staple, together with the other sheets along the tilted sheet discharge tray. Therefore, in the present embodiment, in the case where the sheets have been stapled, they are directly discharged in a bundle onto the sheet discharge tray 16 without the previous discharge of the first page even though there is no sheet on the sheet discharge tray 16 or 18. If necessary, one extra sheet for enhancing the vertical alignment performance may previously be discharged onto the sheet discharge tray 16 or 18 from the standby tray 10 or processing tray 12 before discharge of the stapled sheet bundle T.

In this embodiment having such a configuration, when the staple processing or sorting processing is to be performed after image forming and the preceding post-processing is not finished on the processing tray 12, the standby tray 10 installed above the processing tray 12 waits for the succeeding sheets P. Thereafter, after the processing tray 12 becomes free, the sheets P standing by on the standby tray 10 are dropped and supplied and then are moved onto the processing tray 12. Therefore, the practical feeding path from the standby tray 10 to the processing tray 12 in the sheet post-processing apparatus 7 can be shortened and the sheet post-processing apparatus 7 can be miniaturized.

Further, in the case where there exists no sheet on the sheet discharge tray 16 or 18 at the time of discharge of the sheets P in a bundle, one sheet P is previously discharged before the sorted sheet bundle α or sorted sheet bundle β is discharged. Therefore, when the sorted sheet bundle α or sorted sheet bundle β is discharged, all the sheets P including the lower most sheet α' or sheet β' can vertically be aligned utilizing the tilt of the sheet discharge tray 16 or 18 under substantially the same friction condition. As a result, it is possible to enhance the alignment performance of the sheets P on the sheet discharge tray 16 or 18.

The present invention is not limited to the above embodiment and various modifications are possible within the scope of the invention. For example, a method of dropping and supplying the sheet from the standby tray to processing tray is not limited to one based on the slide movement but may be implemented by a rotational movement. Further, the processing mechanism is not limited but may be any processing mechanism, such as a hole-punching unit, as far as it applies post-processing to the sheets.

Further, the one sheet that is previously discharged onto the sheet discharge tray before the sheet bundle is discharged may be discharged from the standby tray or processing tray.

What is claimed is:

1. A sheet post-processing apparatus comprising:

a processing mechanism that beats down an end of a sheet by a paddle which is arranged at a position where the sheet has been dropped when the sheet is dropped and supplied to a standby tray, and performs post-processing for a sheet discharged from an image forming apparatus;

a sheet discharge tray which is arranged on a downstream side with respect to the processing mechanism and loads the sheet discharged from the image forming apparatus;

a detection mechanism that detects whether the sheet has been placed or not on the sheet discharge tray; and a control mechanism that controls discharging a sheet to the sheet discharge tray so that when there is no sheet on the sheet discharge tray detected by the detection mechanism, one sheet of the sheet bundle is discharged to the sheet discharged tray and then the sheet bundle is discharged in a bundle from the processing mechanism onto the sheet discharge tray.

2. The sheet post-processing apparatus according to claim 1, wherein the control mechanism allows the processing mechanism to discharge the one sheet onto the sheet discharge tray.

3. The sheet post-processing apparatus according to claim 1, wherein the sheet discharge tray is tilted such that the discharge direction front end of the sheet is positioned higher than the discharge direction rear end thereof, and the discharged sheet is set back to the sheet rear end direction to thereby achieve the sheet vertical alignment.

4. The sheet post-processing apparatus according to claim 1, wherein in the case where the sheet bundle to be discharged from the processing mechanism has been stapled, the control mechanism discharges the stapled sheet bundle onto the sheet discharge tray without the previous discharge of the one sheet even though the detection mechanism detects no sheet on the sheet discharge tray.

5. The sheet post-processing apparatus according to claim 1, wherein:

the standby tray which is arranged between the image forming apparatus and sheet discharge tray and which is configured to make a sheet discharged from the image forming apparatus stand by; and further comprising a processing tray which is arranged under the standby tray and between the standby tray and sheet discharge tray and which is configured to receive the dropped and supplied sheet which is discharged from the image forming apparatus, wherein the processing mechanism performs post-processing for the sheet on the processing tray.

6. The sheet post-processing apparatus according to claim 5, wherein the control mechanism allows the standby tray or the processing tray to discharge the one sheet onto the sheet discharge tray.

7. The sheet post-processing apparatus according to claim 5, wherein the sheet discharge tray is tilted such that the discharge direction front end of the sheet is positioned higher than the discharge direction rear end thereof, and the discharged sheet is set back to the sheet rear end direction to thereby achieve the sheet vertical alignment.

8. The sheet post-processing apparatus according to claim 5, wherein in the case where the sheet bundle to be discharged from the processing mechanism has been stapled, the control mechanism discharges the stapled sheet bundle onto the sheet discharge tray without the previous discharge of the one sheet even though the detection mechanism detects no sheet on the sheet discharge tray.

9. The sheet post-processing apparatus according to claim 5, wherein the standby tray is constituted by at least a pair of tray members that support both ends of the sheet, and the tray members are slid to drop and supply the sheet onto the processing tray.

10. The sheet post-processing apparatus according to claim 5, wherein the standby tray is constituted by at least a pair of tray members that support both ends of the sheet, and the tray members are rotated to drop and supply the sheet onto the processing tray.

11. A sheet post-processing method comprising:

loading a plurality of sheets discharged from an image forming apparatus, wherein after a sheet discharged from the image forming apparatus is made to once stand by at a standby tray, it is supplied to a processing tray arranged under the standby tray by beating down an end of a sheet at position where the sheet has been dropped when the sheet is dropped, and thereby a plurality of sheets discharged from the image forming apparatus are loaded on the processing tray;

detecting whether any sheet has been placed on a sheet discharge tray;

discharging one sheet on the sheet discharge tray in the case where no sheet is detected on the sheet discharge tray; and discharging the loaded sheets onto the sheet discharge tray in a bundle after discharging the one sheet onto the sheet discharge tray.

12. The sheet post-processing method according to claim 11, wherein in the case where the loaded sheets have been stapled, the stapled sheet bundle is discharged onto the sheet discharge tray without the previous discharge of the one sheet even though no sheet has been detected on the sheet discharge tray.

13. The sheet post-processing method according to claim 11, wherein in the case where the loaded sheets have been stapled, the stapled sheet bundle is discharged onto the sheet discharge tray without the previous discharge of the one sheet even though no sheet has been detected on the sheet discharge tray.

* * * * *